US008960511B2

(12) United States Patent
Shepherd et al.

(10) Patent No.: US 8,960,511 B2
(45) Date of Patent: Feb. 24, 2015

(54) MODULAR OUTDOOR PACKING SYSTEM

(75) Inventors: Scott M. Shepherd, Jackson, WY (US); Jeffery Goltz, Pinedale, WY (US)

(73) Assignee: Vestpac, Inc., Jackson, WY (US)

( * ) Notice: Subject to any disclaimer, the term of this patent is extended or adjusted under 35 U.S.C. 154(b) by 173 days.

(21) Appl. No.: 12/854,031

(22) Filed: Aug. 10, 2010

(65) Prior Publication Data

US 2012/0037675 A1 Feb. 16, 2012

(51) Int. Cl.

| | |
|---|---|
| ***A45F 3/14*** | (2006.01) |
| ***A45F 3/00*** | (2006.01) |
| ***A45F 4/00*** | (2006.01) |
| ***A45C 15/00*** | (2006.01) |
| ***B32B 5/26*** | (2006.01) |
| ***D03D 11/00*** | (2006.01) |
| ***B32B 5/02*** | (2006.01) |
| ***B32B 27/04*** | (2006.01) |
| ***B32B 27/12*** | (2006.01) |
| ***A45C 3/00*** | (2006.01) |
| ***A45C 7/00*** | (2006.01) |
| ***A45C 13/10*** | (2006.01) |

(52) U.S. Cl.

CPC ... *A45F 3/14* (2013.01); *A45C 3/00* (2013.01); *A45C 7/0086* (2013.01); *A45C 7/009* (2013.01); *A45C 13/10* (2013.01); *A45F 2003/146* (2013.01)

USPC ..... 224/259; 224/623; 224/584; 224/583; 442/32; 442/205; 442/206; 442/207; 442/86

(58) Field of Classification Search

CPC ..... A45F 3/04; A45F 3/14

USPC ..... 224/259, 623, 584, 583; 442/32, 205, 442/206, 207, 86

See application file for complete search history.

(56) References Cited

U.S. PATENT DOCUMENTS

| | | | | | |
|---|---|---|---|---|---|
| 417,301 | A | * | 12/1889 | Weldon | 224/601 |
| 2,375,655 | A | | 5/1945 | Irvin | |
| 2,676,738 | A | * | 4/1954 | Herrick | 224/638 |
| 2,817,472 | A | * | 12/1957 | Parkhurst | 224/575 |
| 2,999,621 | A | * | 9/1961 | Kiser | 224/199 |
| D281,833 | S | | 12/1985 | Carney | |
| D283,546 | S | | 4/1986 | Nathan | |
| 4,706,856 | A | * | 11/1987 | Jacober | 224/153 |
| 4,764,962 | A | * | 8/1988 | Ekman et al. | 381/301 |
| 4,892,241 | A | * | 1/1990 | Mavrakis | 224/640 |
| 5,377,887 | A | | 1/1995 | Garcia | |

(Continued)

OTHER PUBLICATIONS

U.S. Appl. No. 29/389,773, Jan. 22, 2013, Restriction.

(Continued)

*Primary Examiner* — Brian D Nash
*Assistant Examiner* — Derek Battisti
(74) *Attorney, Agent, or Firm* — Workman Nydegger

(57) ABSTRACT

Implementations of the present invention provide devices, systems, and methods for packing equipment that provide for a versatile, comfortable, and convenient modular outdoor packing system that increases the enjoyment of outdoor activities. In general, one or more implementations of the present invention include a modular outdoor pack with multiple interchangeable front packs that are interchangeable with a base back pack. Each interchangeable front pack is configured for a particular outdoor activity allowing the modular outdoor pack to transform into multiple different packs depending on the outdoor activity in which the user is participating.

17 Claims, 17 Drawing Sheets

(56) References Cited

U.S. PATENT DOCUMENTS

| | | | | |
|---|---|---|---|---|
| D366,734 | S | 1/1996 | Arthur | |
| 5,603,441 | A * | 2/1997 | Easter | 224/582 |
| 5,687,896 | A * | 11/1997 | Clift | 224/587 |
| 5,799,851 | A * | 9/1998 | Wulf et al. | 224/583 |
| 5,848,741 | A * | 12/1998 | Fair | 224/160 |
| 5,850,634 | A | 12/1998 | Toombs | |
| 5,927,575 | A * | 7/1999 | Gatling | 224/153 |
| 5,950,896 | A * | 9/1999 | Theodore | 224/647 |
| 5,961,014 | A * | 10/1999 | Knerr | 224/259 |
| D435,168 | S * | 12/2000 | Momburg | D3/215 |
| 6,179,185 | B1 | 1/2001 | Dancyger | |
| D450,448 | S | 11/2001 | Pierce | |
| 6,325,262 | B1 * | 12/2001 | Thompson | 224/628 |
| 6,345,751 | B1 * | 2/2002 | Elliot | 224/646 |
| D461,048 | S | 8/2002 | Blanking | |
| D483,561 | S | 12/2003 | Charpentier | |
| D486,635 | S | 2/2004 | Yagisawa | |
| 6,763,983 | B2 * | 7/2004 | Norman | 224/160 |
| 6,786,375 | B2 | 9/2004 | Worden | |
| D496,774 | S | 10/2004 | Fields-Hale | |
| D498,585 | S | 11/2004 | Darling | |
| D501,990 | S | 2/2005 | Carr | |
| D507,871 | S | 8/2005 | DiMarchi | |
| 6,932,256 | B2 * | 8/2005 | Hale et al. | 224/637 |
| 7,169,720 | B2 * | 1/2007 | Etchells et al. | 442/239 |
| D536,860 | S | 2/2007 | Hoey | |
| 7,210,605 | B2 * | 5/2007 | Willows et al. | 224/637 |
| D572,465 | S | 7/2008 | Beck | |
| D613,497 | S | 4/2010 | Pho | |
| D614,862 | S | 5/2010 | Votel | |
| D622,500 | S | 8/2010 | Pho | |
| 7,996,921 | B1 * | 8/2011 | Snyder | 2/102 |
| D647,693 | S | 11/2011 | Olegard | |
| D649,345 | S | 11/2011 | Bergkvist | |
| 8,047,413 | B2 | 11/2011 | Arajakis | |
| D655,495 | S | 3/2012 | Sauer | |
| D664,351 | S | 7/2012 | Bergkvist | |
| D672,547 | S | 12/2012 | Bettauer | |
| 2004/0060954 | A1 * | 4/2004 | Hale et al. | 224/581 |
| 2004/0069827 | A1 * | 4/2004 | Stewart | 224/577 |
| 2004/0140335 | A1 * | 7/2004 | Hancock et al. | 224/637 |
| 2006/0011690 | A1 | 1/2006 | Bareno | |
| 2006/0261104 | A1 * | 11/2006 | Zambrzycki | 224/158 |
| 2008/0073391 | A1 * | 3/2008 | Frost | 224/160 |
| 2009/0180715 | A1 | 7/2009 | Wittke-Kothe | |
| 2012/0024924 | A1 | 2/2012 | Hexels | |
| 2012/0047618 | A1 | 3/2012 | Phillips | |
| 2012/0241487 | A1 | 9/2012 | Zack | |
| 2013/0036535 | A1 | 2/2013 | Bergkvist | |
| 2013/0043291 | A1 | 2/2013 | Davis | |

OTHER PUBLICATIONS

U.S. Appl. No. 29/367,663, Sep. 13, 2012, Notice of Allowance
U.S. Appl. No. 29/367,663, Dec. 19, 2012, Notice of Allowance.
U.S. Appl. No. 29/367,663, filed Aug. 11, 2010, Shepherd.
U.S. Appl. No. 29/389,773, filed Apr. 15, 2011, Shepherd.
U.S. Appl. No. 29/367,663, Mar. 7, 2013, Notice of Allowance.
U.S. Appl. No. 29/389,773, Mar. 1, 2013, Office Action.
U.S. Appl. No. 29/389,773, May 13, 2013, Notice of Allowance.

* cited by examiner

MODULAR OUTDOOR PACKING SYSTEM

BACKGROUND OF THE INVENTION

1. The Field of the Invention

This invention relates to devices, systems, and methods for outdoor packs and packing equipment.

2. Background and Relevant Art

Outdoor activities, such as biking, hiking, boating, fishing, running, skiing, and snowboarding are becoming increasingly popular. One reason for the increased popularity of outdoor activities is the availability of outdoor products that make outdoor activities more enjoyable. One broad example of an outdoor product that outdoor enthusiasts use to make outdoor activities more enjoyable are outdoor packs, such as backpacks, that carry items that outdoor enthusiasts may want while participating in outdoor activities.

Unfortunately, conventional outdoor packs may have a variety of limitations and disadvantages that may inhibit enjoyment of outdoor activities. For example, conventional outdoor packs designs may include a configuration that is useful for only a single outdoor activity. In particular, an outdoor enthusiast that participates in several different outdoor activities often must purchase several different outdoor packs. Therefore, the outdoor enthusiast may have to store and/or carry several different outdoor packs for a particular outdoor adventure if they plan on doing more than one outdoor activity.

In addition, many conventional outdoor packs are one dimensional in their function. In particular, one popular outdoor pack is a backpack configured to carry a water pouch such that the outdoor enthusiast can have water available to drink while participating in the outdoor activity. However, water pouch backpacks often are very limited in that they only may be configured to carry the water pouch, and thus do not allow the outdoor enthusiast the ability to carry additional items in addition to the water pouch. Therefore, if an outdoor enthusiast wants to have a water pouch, as well as carry additional items, the outdoor enthusiast often has to wear more than one outdoor pack, or simply not carry the additional items.

In addition to being one dimensional, many conventional outdoor packs may not allow access to the storage areas of the outdoor pack while the outdoor enthusiast wears the outdoor pack. Often times, an outdoor enthusiast may need convenient access to portable medial players, wireless phones, or other items when these items are stored in the outdoor pack. However, many conventional outdoor packs rest solely on the back of the outdoor enthusiast and provide limited access to the contents of the outdoor pack while the outdoor enthusiast is wearing the outdoor pack.

Moreover, conventional outdoor packs often interfere with other outdoor equipment needed to participate in particular outdoor activities. For example, many skiers and snowboarders wish to wear an outdoor pack with a water pouch while skiing or snowboarding. However, conventional outdoor packs for water pouches are designed to be worn over a coat. Because the outdoor pack places the water pouch on the outside of the coat, often times the water will freeze, thus frustrating the skier or snowboarder's ability to drink water from the water pouch.

In addition, conventional outdoor packs may not be comfortable to wear while participating in an outdoor activity. One of the biggest comfort problems of conventional outdoor packs is that many outdoor packs are hot to wear due to the fact that conventional outdoor packs rest directly on the outdoor enthusiasts back. This may cause the outdoor enthusiast to sweat where the outdoor pack rests against the outdoor enthusiast's body. After prolonged periods of time, the hot outdoor packs cause the outdoor enthusiast to become uncomfortable, and thus the enjoyment of the outdoor activity decreases.

Accordingly, there are a number of disadvantages in conventional outdoor packs that can be addressed.

BRIEF SUMMARY OF THE INVENTION

Implementations of the present invention provide devices, systems, and methods for packing equipment that provide for a versatile, comfortable, and convenient modular outdoor packing system that increases the enjoyment of outdoor activities. In general, one or more implementations of the present invention include a modular outdoor pack with multiple interchangeable front packs that are interchangeable with a base back pack. Each interchangeable front pack is configured for a particular outdoor activity allowing the modular outdoor pack to transform into multiple different packs depending on the outdoor activity in which the user is participating.

In one implementation, a modular outdoor packing system includes a base back pack configured to be worn on a back area of a user. The modular outdoor packing system can further include a plurality of interchangeable front packs configured to be worn on a chest area of the user. In addition, the modular outdoor packing system includes a plurality of detachable straps that selectively connect the base back pack with the plurality of interchangeable front packs one at a time to form a plurality of modular outdoor packs. The plurality of interchangeable front packs can each have varying configurations and characteristics for varying outdoor activities.

In another example, a modular outdoor pack includes a base back pack that a user wears on the user's back area and a first interchangeable front pack that the user wears on the user's chest area. The modular outdoor pack further includes a plurality of straps that connect the base back pack to the interchangeable front pack to form a modular outdoor pack where the interchangeable front pack is disconnectable from the plurality of straps and can be removed from the modular outdoor pack.

In another example implementation, a modular outdoor pack includes a base back pack that a user wears on the user's back area and an interchangeable fish pack that the user wears on the user's chest area. The interchangeable fish pack includes a foldable front portion having an open position and a closed position and a mounting surface that is revealed when the foldable front portion is in the open position. The modular outdoor pack further includes a plurality of straps that connect the base back pack to the interchangeable fish pack to form the modular outdoor pack, where the interchangeable fish pack is disconnectable from the plurality of straps and removable from the modular outdoor pack.

Additional features and advantages of exemplary implementations of the present invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
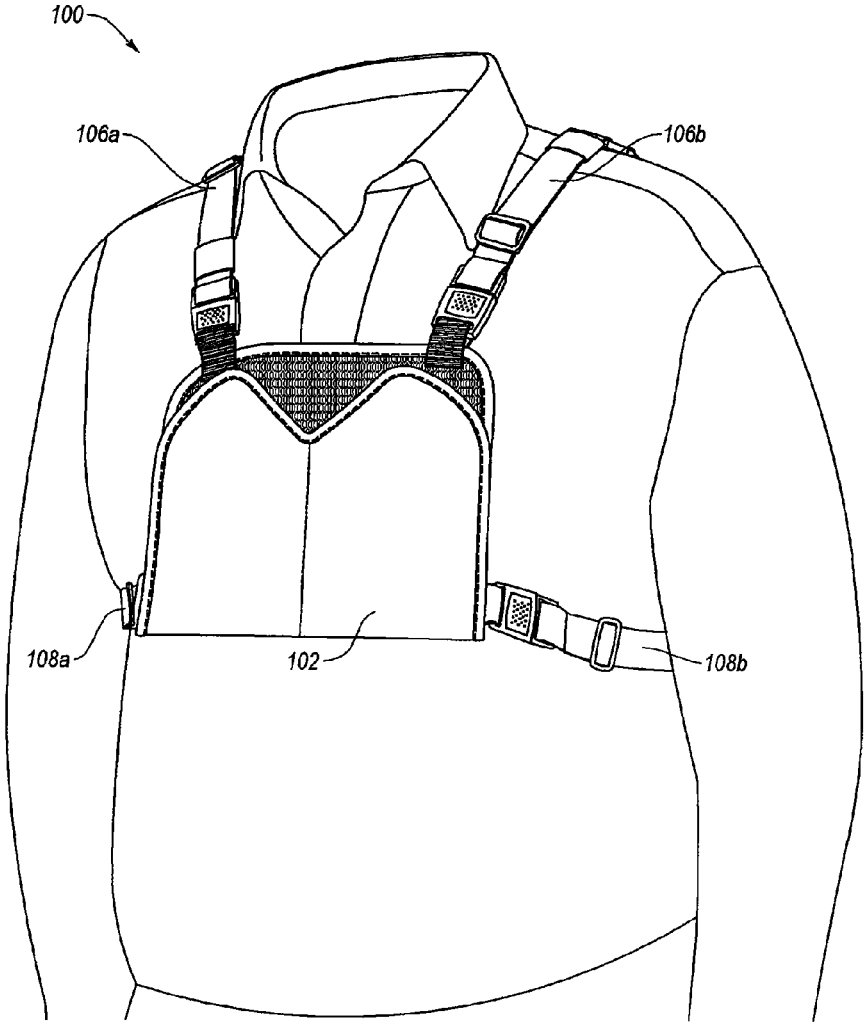
FIG. 1A illustrates a front view of a user wearing an example of a modular packing system.

Implementations of the present invention provide devices, systems, and methods for packing equipment that provide for a versatile, comfortable, and convenient modular outdoor packing system that increases the enjoyment of outdoor activities. In general, one or more implementations of the present invention include a modular outdoor pack with multiple interchangeable front packs that are interchangeable with a base back pack. Each interchangeable front pack is configured for a particular outdoor activity allowing the modular outdoor pack to transform into multiple different packs depending on the outdoor activity in which the user is participating. The interchangeable characteristics of the modular outdoor pack allow a user to use the modular outdoor pack for various outdoor activities. For example, a user can interchange various interchangeable front packs with varying design, size, and configuration with the same base back pack to create custom outdoor packs for particular activities. Thus, the outdoor pack provides the user with added flexibility and customization when compared to conventional outdoor packs and reduces the number of different outdoor packs a user needs to carry or store in order to participate in multiple different outdoor activities.

In addition, implementations of the modular outdoor pack provide a base back pack configured to carry a water pouch, while the interchangeable front packs can carry various items needed by the user. Therefore, unlike many conventional water pouch outdoor packs, the modular outdoor pack allows a user to carry both water and other items simultaneously in the same outdoor pack.

Moreover, due to the configuration of the interchangeable front packs, the interchangeable front packs are placed on the user's chest area allowing the user easy access to the contents of the interchangeable front pack. For example, the user can place items such as portable media players, wireless telephones or other items to which the user needs easy access while wearing the modular outdoor pack and participating in an outdoor activity.

Implementations of the modular outdoor pack also provide an outdoor pack that is slim in design and light weight compared to many conventional outdoor packs. Due to the slim design and light weight, the modular outdoor pack does not interfere with other outdoor equipment when participating in various outdoor activities. For example, the modular outdoor pack can be worn over or underneath a coat allowing a user to effectively use the modular outdoor pack when skiing or snowboarding.

Furthermore, implementations of the modular outdoor pack also include various materials that make the modular outdoor pack more comfortable compared to many conventional outdoor packs. In particular, the surface of the outdoor pack that contacts the user's body is made from a nylon air mesh material that comfortably holds the modular outdoor pack away from the user's body allowing for maximum ventilation and cooling between the modular outdoor pack and the user's body.

The above features and characteristics will be described in more detail with reference to the included figures. FIG. 1A illustrates an example implementation of the modular outdoor pack 100 shown on a user. Generally, as FIG. 1 illustrates, the modular outdoor pack 100 includes an interchangeable front pack 102 that the user wears on the chest area. As illustrated, the modular outdoor pack 100 allows a user to carry items both on the front of the user's body as well as on the back of the user's body, thus providing a better balanced pack compared to more conventional outdoor packs.

Figure 1B:
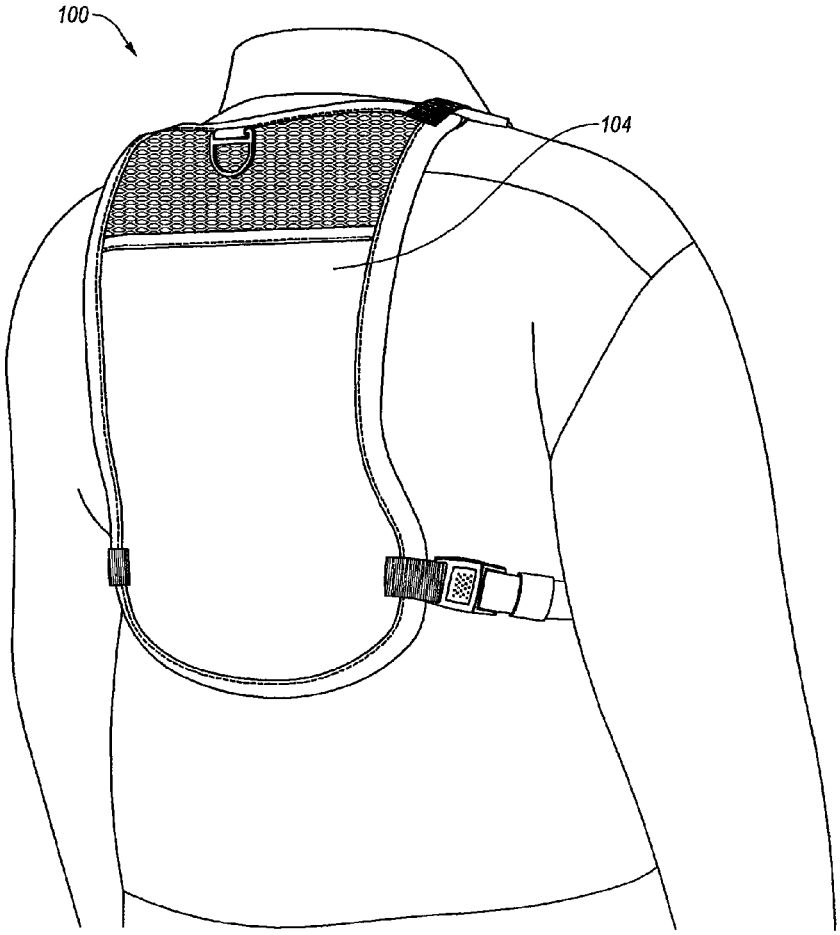
FIG. 1B illustrates a back view of a user wearing an example of a modular packing system.

As shown in FIGS. 1A and 1B, the interchangeable front pack 102 is connected to the base back pack with two shoulder straps 106*a* and 106*b* and two side straps 108*a* and 108*b*. The shoulder straps 106*a* and 106*b* and the side straps 108*a* and 108*b* provide a comfortable secure fit that securely holds the modular outdoor pack 100 to the user's body. In particular, the shoulder straps 106*a* and 106*b* vertically support the modular outdoor pack 100 on the user's shoulders, while the side straps 108*a* and 108*b* horizontally support the modular outdoor pack 100 around the user's midsection preventing the modular outdoor pack 100 from swinging from side to side while the user participates in an outdoor activity.

Although FIGS. 1A and 1B illustrate the modular outdoor pack 100 as having both the interchangeable front pack 102 and the base back pack 104, the user can customize the modular outdoor pack 100 such that the modular outdoor pack 100 only includes the base back pack 104. For example, and as will be explained further below, a user can remove the interchangeable front pack 102 portion. The shoulder straps 106*a* and 106*b* and the side straps 108*a* and 108*b* are then connected to one another, either directly or through a connection piece (not shown), on the chest region to create a standalone base back pack 104 when the user is not in need of the front interchangeable pack 102.

Likewise, the base back pack 104 can be removed from the modular outdoor pack 100 illustrated in FIG. 1 such that the user can customize the modular outdoor pack to only include the interchangeable front pack 102. For example, a user can remove the base back pack 104. The shoulder straps 106*a* and 106*b* and the side straps 108*a* and 108*b* are then connected to another, either directly or through a connection piece (not shown), on the back region to create a standalone front interchangeable pack 102 when the user is not in need of the base back pack 104.

Figure 2A:
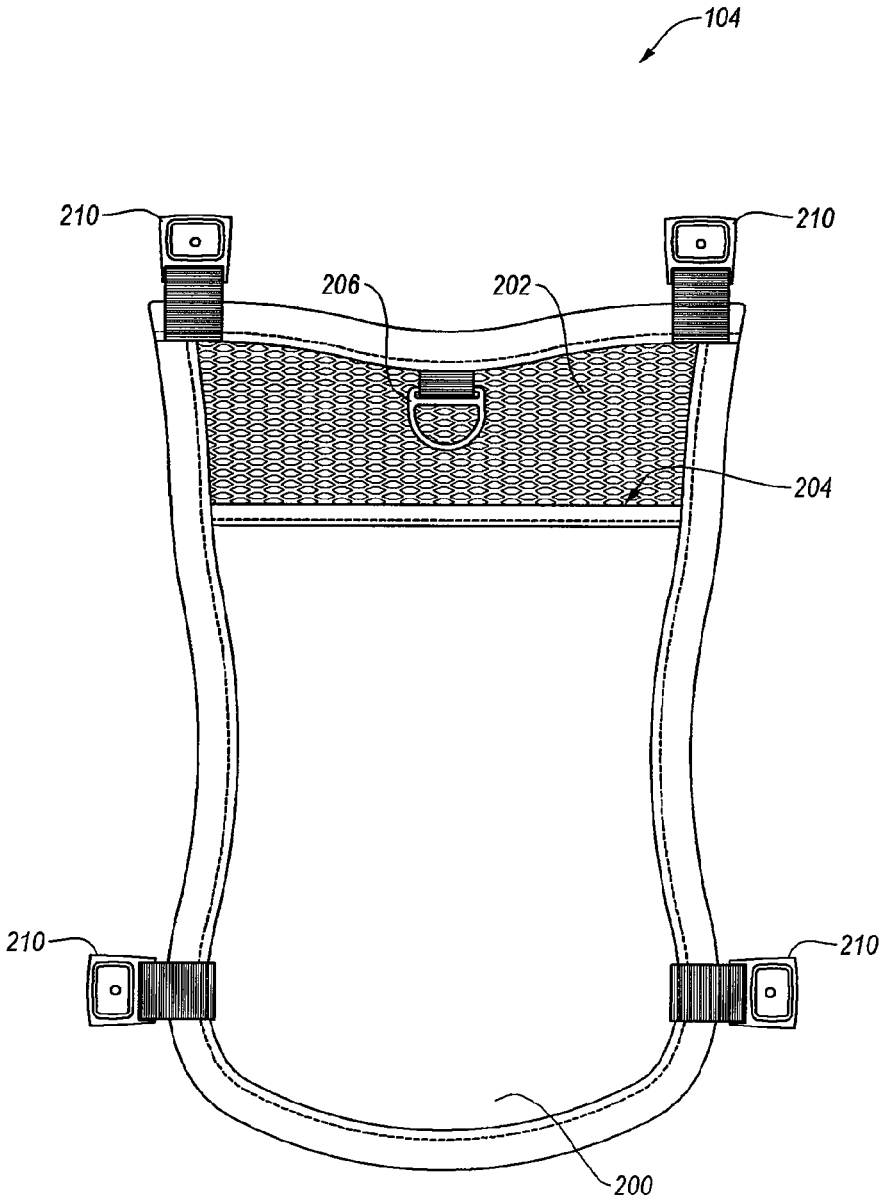
FIG. 2A illustrates a front view of an example of a base back pack for use with a modular packing system.

Just as a user can remove the interchangeable front pack 102 and the base back pack 104 from the modular outdoor pack 100, the user can also exchange the different variations of the interchangeable front pack 102 and the base back pack 104 to customize the modular outdoor pack 100 for a particular outdoor activity. For example, FIG. 2A illustrates one example implementation of the base back pack 104. The base back pack 104 illustrated in FIG. 2A includes a front portion 200 coupled to a back portion 202 around the perimeter of the base back pack 104, thus creating a pouch 204 between the front portion 200 and back portion 202.

In particular, a user can utilize the pouch 204 to carry a water pouch (not shown). In one example implementation, the water pouch is positioned within the pouch 204 such that a water hose extends out the top of the pouch 204 and through a ring 206 which holds the water hose in place to allow the user to have access to a bite valve on the end of the water hose. In alternative implementations, the base back pack 104 can have alternate configurations that are designed to carry other items in addition to, or instead of, a water pouch. For example, the base back pack 104 can include various pockets, pouches, hooks, straps, and other features such that the user can store and carry a variety of outdoor equipment.

Just as the configuration of the base back pack 104 can vary from one implementation to the next, so too can the size of the base back pack 104 vary. FIG. 2A illustrates one example base back pack 104 sized with a pouch that can carry off-the-shelf water pouches. However, the front portion 200 and back portion 202 can be sized to create a larger or smaller pouch 204 to allow a user to carry the exact amount of water necessary for a particular outdoor activity, thus limiting unnecessary weight.

In addition to the various sizes of the base back pack 104, the base back pack 104 can be made from a variety of materials. For example, one implementation of the base back pack 104 includes a front portion 200 made from neoprene. Neoprene material is a breathable light-weight material that has elastic properties allowing the pouch 204 to securely hold any items placed within the pouch 204. In alternative implementations, the front portion 200 can be made from nylon, canvas, polyester or other similar fabrics or materials.

Figure 2B:
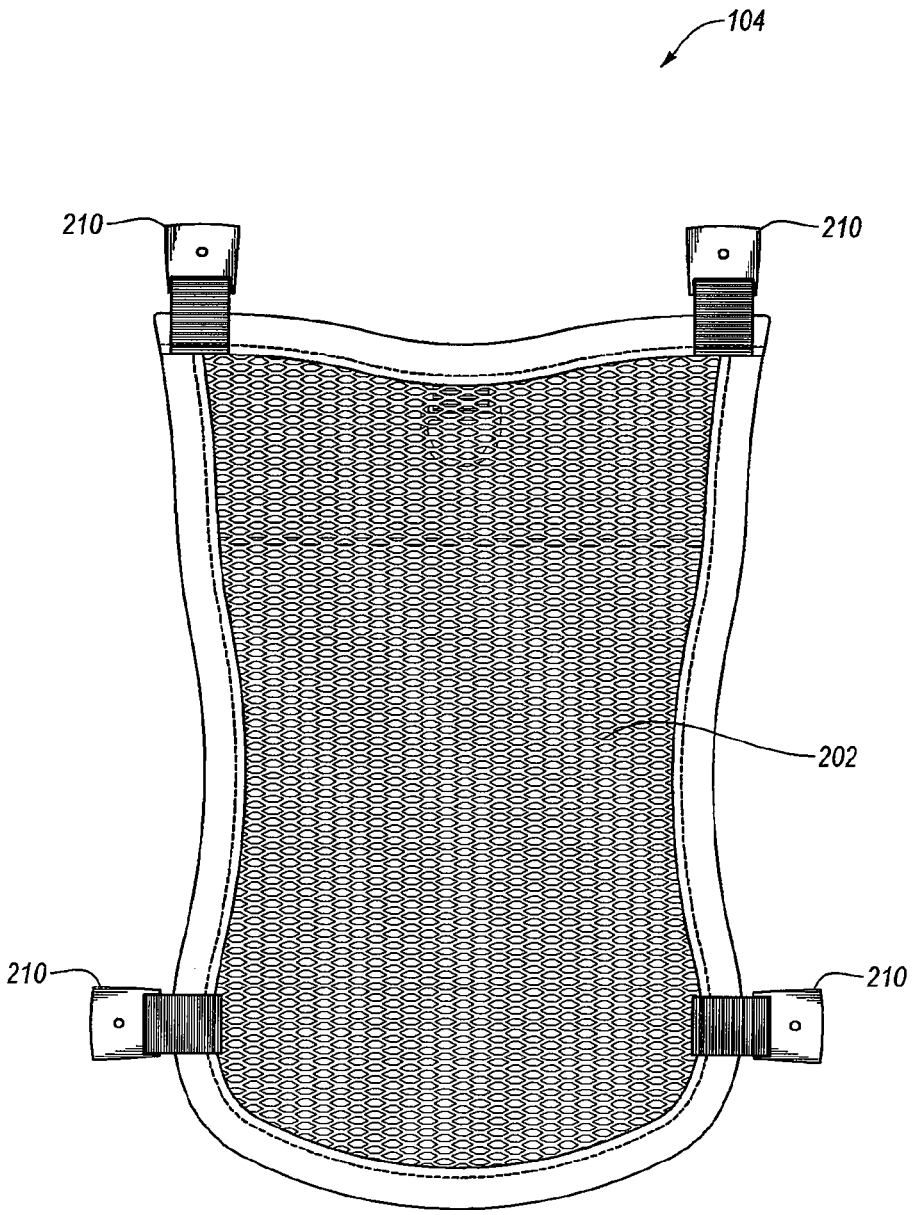
FIG. 2B illustrates a back view of an example of a base back pack for use with a modular packing system.

Similar to the front portion 200, the back portion 202 can be made from various materials. In one example implementation the back portion 202 is made from an air mesh nylon or polyester material, also known as spacer fabric. FIG. 2B illustrates a back view of the base back pack 104 that shows the back portion 202 in additional detail. As FIG. 2B illustrates, the air mesh material covers nearly the entire back portion 202 to create an extremely breathable and ventilating surface to rest against a user's body, as well as provide a soft cushion against the user's back.

In particular, in one example the air mesh material includes a top and bottom layer of linked nylon or similar material. The top and bottom layer of the linked nylon are coupled together with strands of nylon that are woven through the top and bottom layers of linked nylon such that the strands of nylon actually create a compressible support structure between the top and bottom layer of linked nylon. Thus the air mesh material creates a comparatively large air space between the top and bottom layer of the linked nylon allowing for exceptional ventilation properties, as well as a comfortable cushion surface to rest against a user's body.

The air mesh material can vary from one implementation to the next to create various characteristics of the back portion 202. For example the strands of nylon woven between the top and bottom linked layers can vary in length, cross-sectional dimension, and stiffness, creating varying cushion characteristics as well as ventilation characteristics. In alternative implementations, various other materials such as nylon, polyester, neoprene or any other material can be used to create the back portion 202.

Notwithstanding the various materials in which the base back pack 104 is made, the base back pack 104 includes one or more connectors 210 to connect to the shoulder straps 106*a* and 106*b* and side straps 108*a* and 108*b*. For example, FIGS. 2A and 2B illustrate that the base back pack 104 can include four connectors 210 located proximate to the corner regions of the base back pack 104. In alternative implementations, the number of connectors 210 and the location of the connectors 210 can vary from one implementation to next.

Figure 2C:
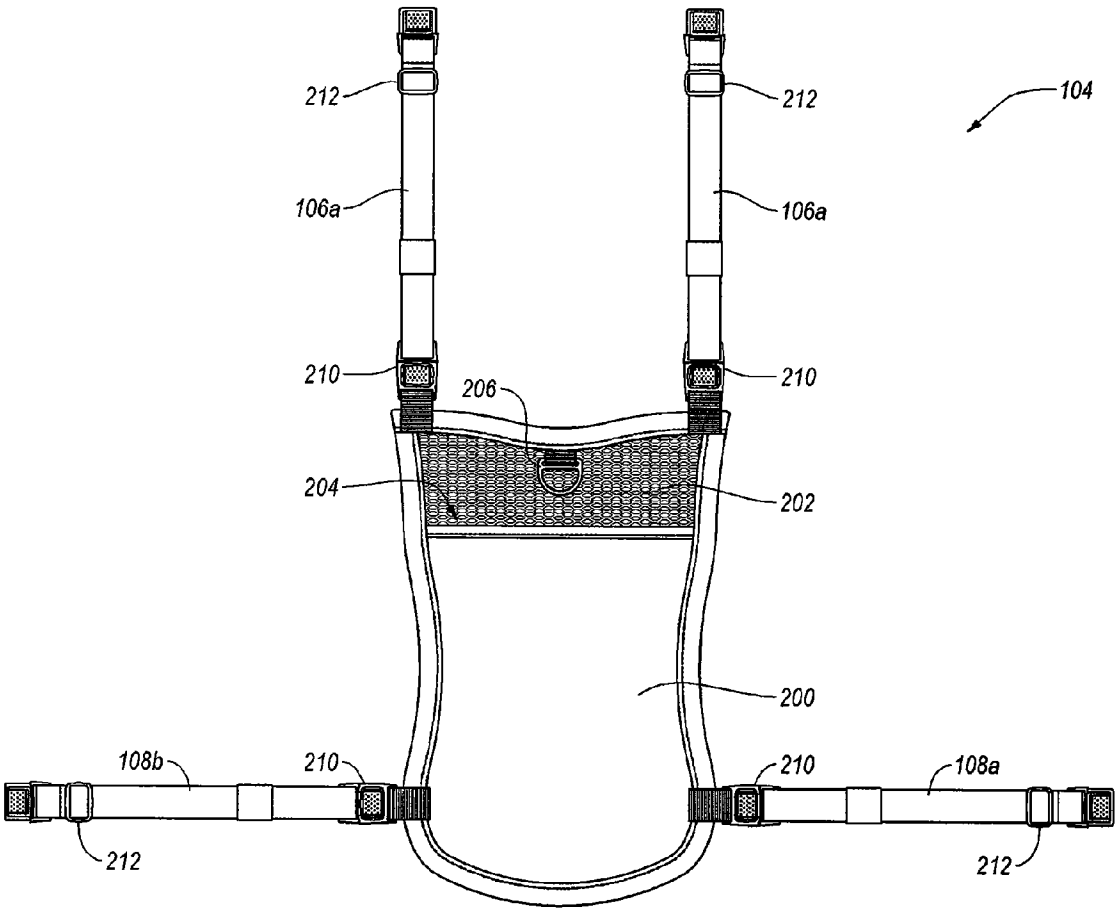
FIG. 2C illustrates a front view of an example base back pack connected to example connection straps.

FIG. 2C illustrates the base back pack 104 connected to the shoulder straps 106*a* and 106*b* as well as the side straps 108*a* and 108*b*. As illustrated, in one implementation the connectors 210 can be a snap-type connector wherein the connectors 210 on the base back pack 104 are a female connector and that connects with a corresponding male connector on the shoulder straps 106*a* and 106*b* and side straps 108*a* and 108*b*. The snap-type connection allows a user to easily and quickly interchange various components on the modular outdoor pack 100. In alternative implementations, other types of connectors 210 such as VELCRO, hooks, snaps or other similar connectors can be used.

Regardless of the type of connector 210, the shoulder straps 106*a* and 106*b*, as well as the side straps 108*a* and 108*b*, can include various features and characteristics. For example, FIG. 2C illustrates that the shoulder straps 106*a* and 106*b* and side straps 108*a* and 108*b* can include an length adjuster 212 such that a user can customize the length of the shoulder straps 106*a* and 106*b* and side straps 108*a* and 108*b*. Moreover, the shoulder straps 106*a* and 106*b* and side straps 108*a* and 108*b* can come in various lengths to fit various sizes of users. Thus, the same modular outdoor pack 100 can be used by two or more users that have large differences in their height and weight without the need to buy an entire new outdoor pack, as with conventional designs.

Figure 2D:
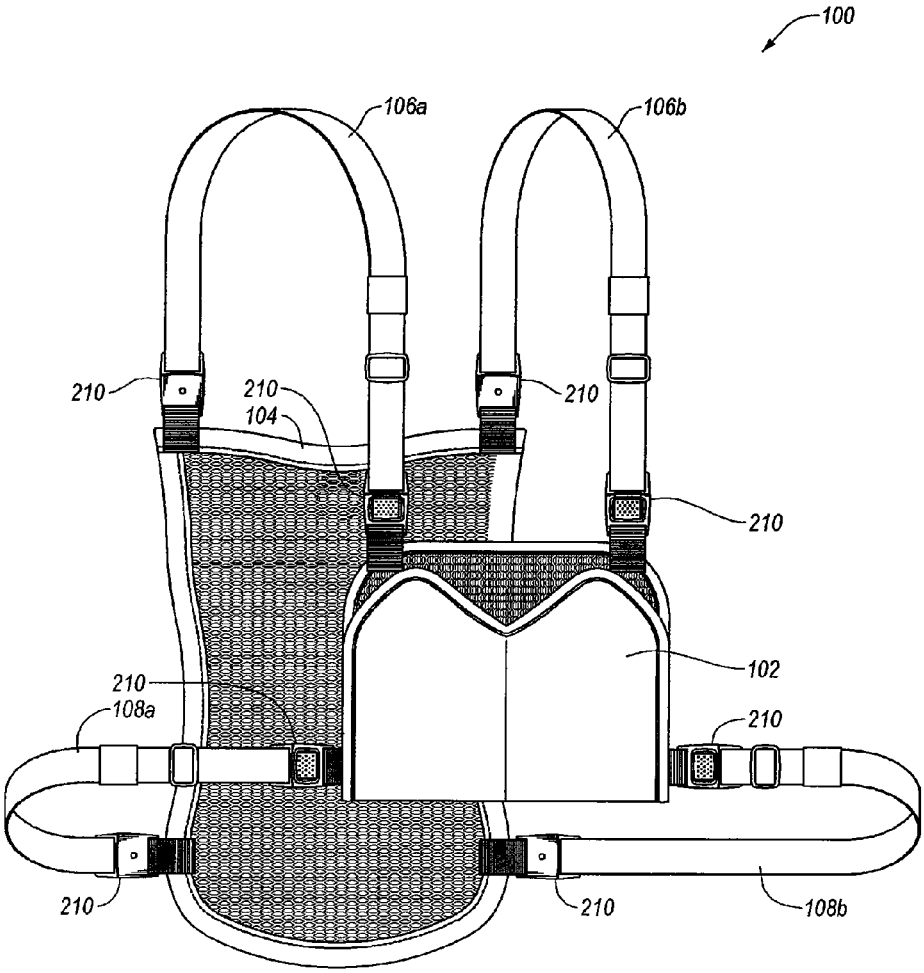
FIG. 2D illustrates a front view of an assembled example of the modular packing system with an interchangeable front pack connected to a base back pack.

The shoulder straps 106*a* and 106*b* and side straps 108*a* and 108*b* also connect to the interchangeable front pack 102 using similar connectors 210 as described above. Once the shoulder straps 106*a* and 106*b* and side straps 108*a* and 108*b* are connected to both the interchangeable front pack 102 and the base back pack 104, a fully assembled modular outdoor pack 100 is ready for use. In particular, FIG. 2D illustrates one example of the modular outdoor pack 100 that is fully assembled and ready to wear.

As described above, the interchangeable front pack 102 can take various formations and have various characteristics depending on the type of outdoor activity in which the user is wearing the modular outdoor pack 100. In particular, FIGS. 3A through 5B illustrate example interchangeable front packs 102. Although FIGS. 3A through 5B illustrate example interchangeable front packs 102, the invention is not limited to solely the illustrated implementations of the interchangeable front pack; rather, the invention includes any configuration of an interchangeable front pack that is designed to connect to and cooperate with the modular outdoor pack 100.

Figure 3A:
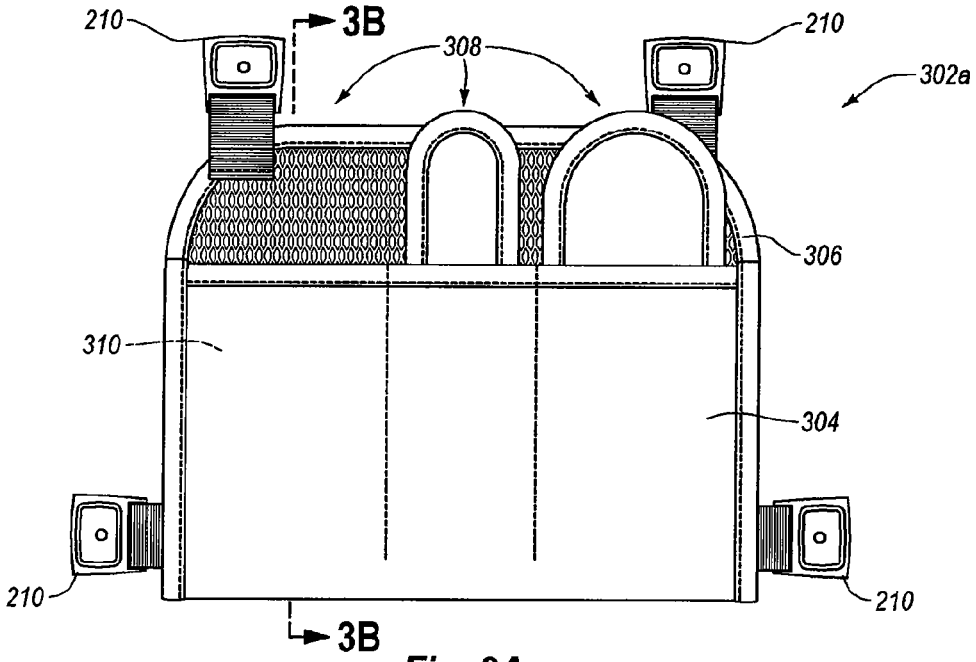
FIG. 3A illustrates one example of an interchangeable front pack for use with the modular packing system illustrated in FIG. 2D.

Notwithstanding the foregoing, FIG. 3A illustrates that an interchangeable front pack 302*a* having a front portion 304 and a back portion 306 and is configured and sized to be worn on a user's chest. In one example implementation, the interchangeable front pack 302*a* can have a width of about nine inches and a height of about seven inches. Of course, the interchangeable front pack 302*a* can have variety of sizes that includes widths larger or smaller than about nine inches, and heights larger or smaller than about seven inches. The actual dimensions of the interchangeable front pack 302*a* can vary based on the outdoor activity, the amount of storage a user desires, and/or the desired weight of the interchangeable front pack 302*a*.

Moreover, the thickness of the interchangeable front pack 302*a* can vary from one implementation to the next. In general, the thickness of both the interchangeable front pack 302*a* and the base back pack 104 ranges between about 0.25 inches to about 0.75 inches. In particular, example implementations of both the interchangeable front pack 302*a* and the base back pack 104 have a width of 0.50 inches or less to provide an ultra-slim configuration for the modular packing system 100. The ultra-slim configuration allows a user to wear the modular packing system as a layer that can be worn on top of clothing, or alternatively, underneath clothing.

In addition to various sizes and materials, the interchangeable front pack 302*a* can include a variety of features and characteristics that provide a user with a wide range of versatility. For example, the interchangeable front pack 302*a* can include one or more pockets 308. In particular, FIG. 3A illustrates that the interchangeable front pack 302*a* includes three pockets 308 that are positioned across the front portion 304 of the interchangeable front pack 302*a*. The sizes and configurations of the pockets 308 can vary from one implementation to the next.

For example, in one example implementation, as shown in FIG. 3A, two of the three pockets 308 can have substantially the same dimensions. In particular, FIG. 3A illustrate one example interchangeable front pack 302*a* with two outside pockets 308 that have a width of about three inches and a middle pocket 308 with a width of about two inches. In an alternative implementation, the three pockets 308 can all have equal widths, or the two larger pockets 308 can be positioned adjacently, while the third smaller pocket is positioned on the outside of the interchangeable front pack 302*a*.

In addition to the above mentioned configuration, the pockets 308 can have a custom size and configuration for a particular piece of equipment. For example, one or more pockets 308 can have a configuration and size to hold a particular cell phone, MP3 player, GPS system, identification card, or other item that a user desires to carry while participating in an outdoor activity. Additionally, the pockets 308 can include other features, such as holes, hooks, guides that help guide wires and/or cables out of the pockets 308. For example, the pockets 308 can include a small hole that allows a user to efficiently thread a headphone cable through the pocket 308 to connect to an MP3 player.

Figure 3B:
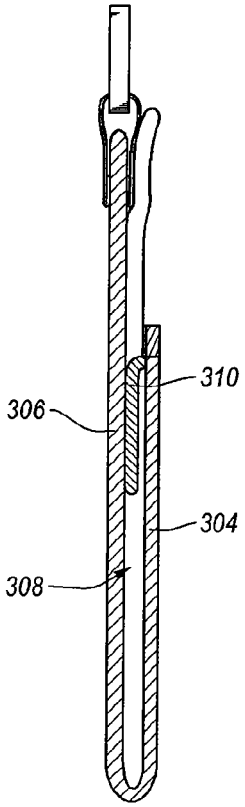
FIG. 3B illustrates a cross-sectional view of the interchangeable front pack shown in FIG. 3A.

As FIGS. 3A and 3B illustrates, the interchangeable front pack 302*a* further includes pocket flaps 310 that a user can utilize to close and secure the contents of the pockets 308. In particular, the pocket flaps 310 provide an easy way for a user to close the pockets when participating in outdoor activities, including activities that require the use of gloves and other equipment. For example, the user can fold and tuck the pocket flaps 310 into the respective pockets 308 such that the pocket flaps 310 substantially seal the contents of the pockets 308 within the pockets, as FIG. 3B illustrates.

In one implementation, the pocket flaps 310 can have a length of about three inches to allow a user to fold and tuck the pocket flaps 310 about half-way down the height of the pockets 308, thus securing the pocket flaps 310 into the pockets 308. In particular, FIG. 3B includes a zoomed in side view of one pocket with the pocket flap 310 in the closed position. As illustrated, a user can fold the pocket flap 310 into the pocket 308 such that the pocket 308 is fully enclosed by the front portion 304 and the pocket flap 310 to secure the contents of the pocket 308 during an outdoor activity.

Although FIG. 3A illustrates that all the pockets 308 includes the pocket flaps 310, in alternative implementations the pockets 308 can have various other closure devices. For example, the pocket flaps 310 could include a fastening device (e.g., VELCRO or snaps) to allow a user to fasten the pocket flaps 310 to the front portion 304 to secure the contents of the pockets 308. In addition implementations, the pockets 308 do not include any pocket flaps and instead use the elastic compression properties of the front portion material to secure the contents of the pockets 308.

Figure 3C:
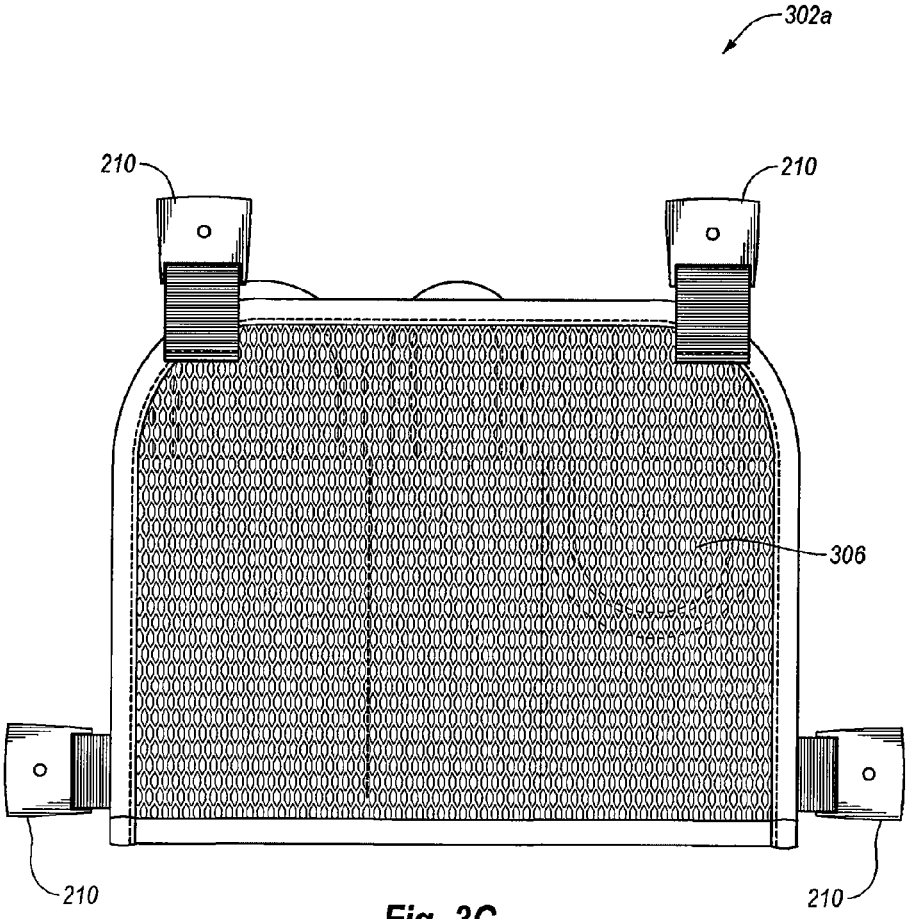
FIG. 3C illustrates a rear view of the example of an interchangeable front pack shown in FIG. 3B.
Figure 3D:
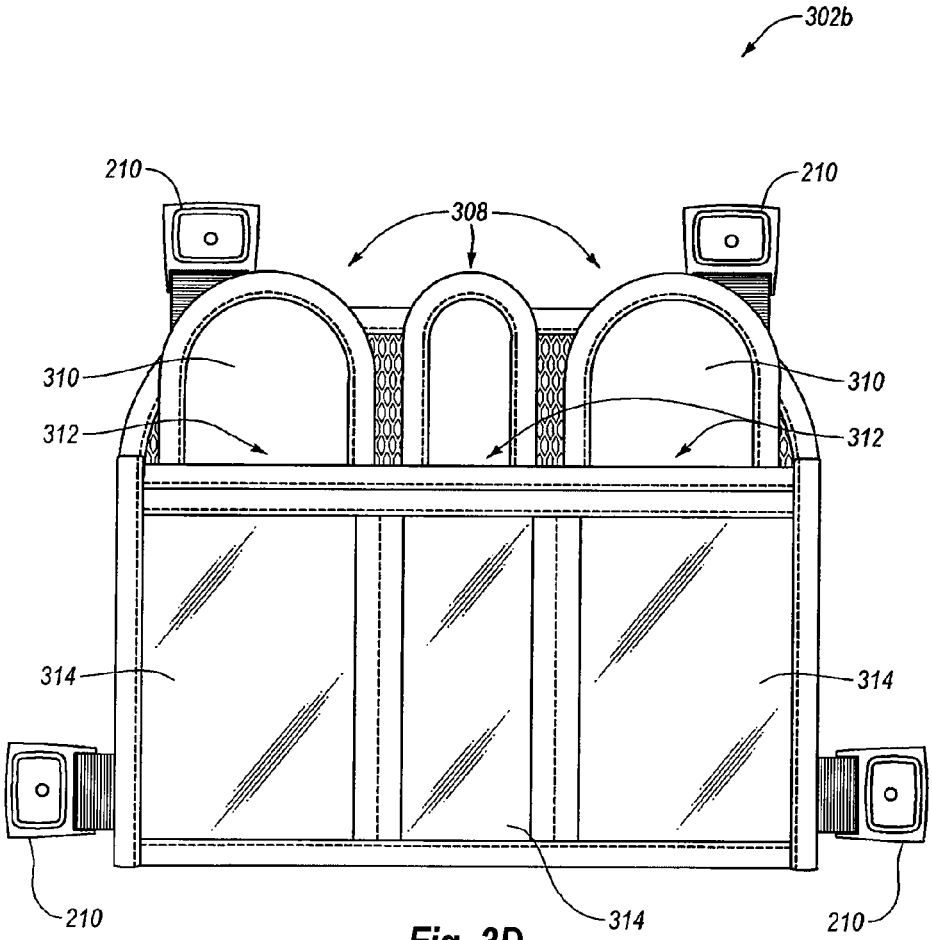
FIG. 3D illustrates an example of an interchangeable front pack with transparent pockets.

In addition to the various pocket 308 configurations illustrated in FIGS. 3A-3B, FIG. 3D illustrates yet a further implementation of an interchangeable front pack 302*b*. In particular, FIG. 3D illustrates that the interchangeable front pack 302*b* includes transparent pockets 312 that are positioned in front of pockets 308. Specifically, FIG. 3D illustrates that the transparent pockets 312 include a transparent front portion 314 that allows a user to view the contents of transparent pockets 312. In one implementation, the transparent front portion 314 includes a flexible transparent plastic material.

For example, a user can place a ski pass, or similar identification card, into one of the transparent pockets 312 so that the ski pass is visible through the transparent front portion 314. In this way, a skier can securely store the ski pass in the transparent pockets 312, and yet still have easy visible access to the pass when needed. In addition, a user could store a MP3 player or cell phone such that the user could have visible access to the electronic device without having to remove the device from the transparent pockets 312.

As FIG. 3D illustrates, the transparent pockets 312 correspond directly with the pockets 308 (i.e., the number and size of the transparent pockets 312 substantially correspond with the pockets 308). In an alternative implementation, the number and configuration of the transparent pockets 312 can vary from the number and configuration of the pockets 308. For example, in one implementation of the interchangeable front portion 302 can include three pockets 308 as illustrated in FIGS. 3A and 3C, except only include two equally sized transparent pockets 312 that have transparent front portions 314.

In addition to the pockets 308, pocket flaps 310 and transparent pockets 312, the interchangeable front packs 302*a* and 302*b* can further include a variety of straps, hooks, loops and other fasteners to secure equipment to the interchangeable front packs 302*a* and 302*b*. In one implementation, the variety of straps, hooks, loops and other fasteners are removable to allow a user to customize the interchangeable front pack 302*a* and 302*b*.

Regardless of the various configurations and features of the interchangeable front pack 302*a* and 302*b*, FIG. 3C illustrates a back view of one example implementation of an interchangeable front pack 302*a* having a front portion 304 and a back portion 306. The front portion 304 and back portion 306 of the interchangeable front pack 302*a* can be made from the same types of materials as described above with reference to the base back pack 104. In particular, the back portion 306 can be made from an air mesh material that provides exceptional ventilation and cushioning properties for the user.

As illustrated in FIG. 3C, substantially the entire back portion 306 can be made from an air mesh material as described above with respect to the base back portion 104. In an alternative implementation, the back portion 306 of the interchangeable front pack 302*a* can be made with portions of air mesh material and portions of other materials such as nylon, polyester, canvass, or other similar materials.

Figure 4A:
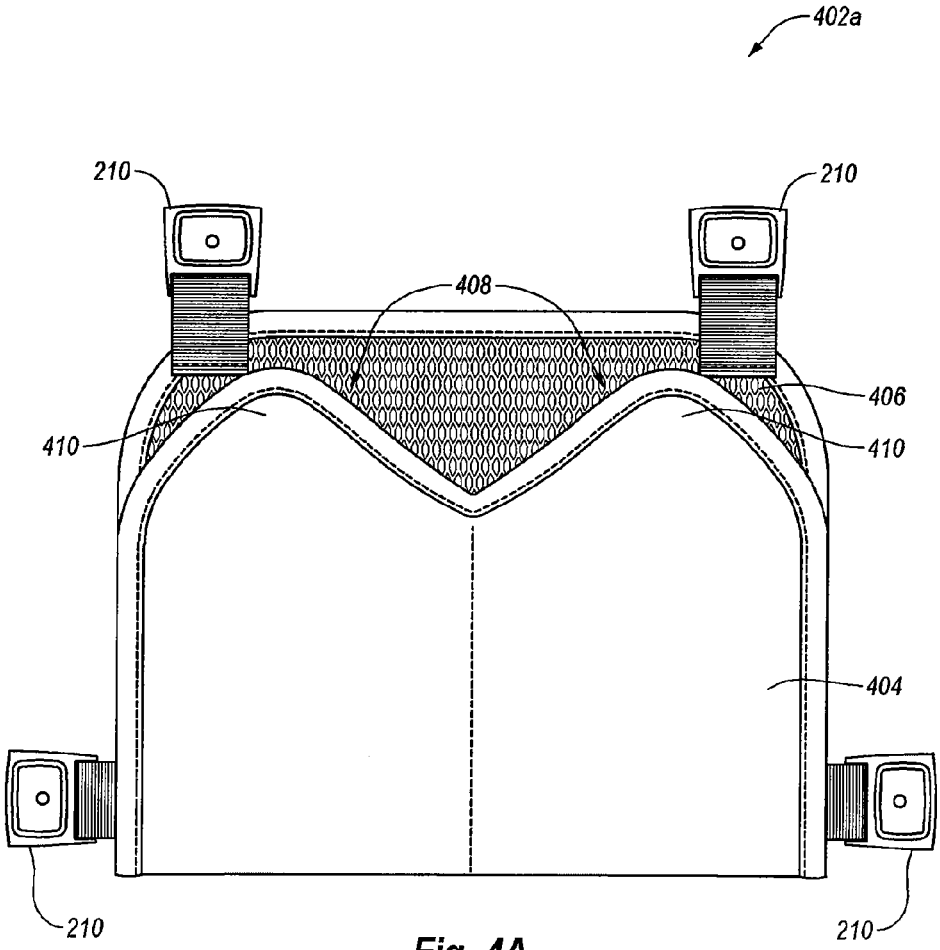
FIG. 4A illustrates another example of an interchangeable front pack for use with the modular packing system illustrated in FIG. 2D.
Figure 4B:
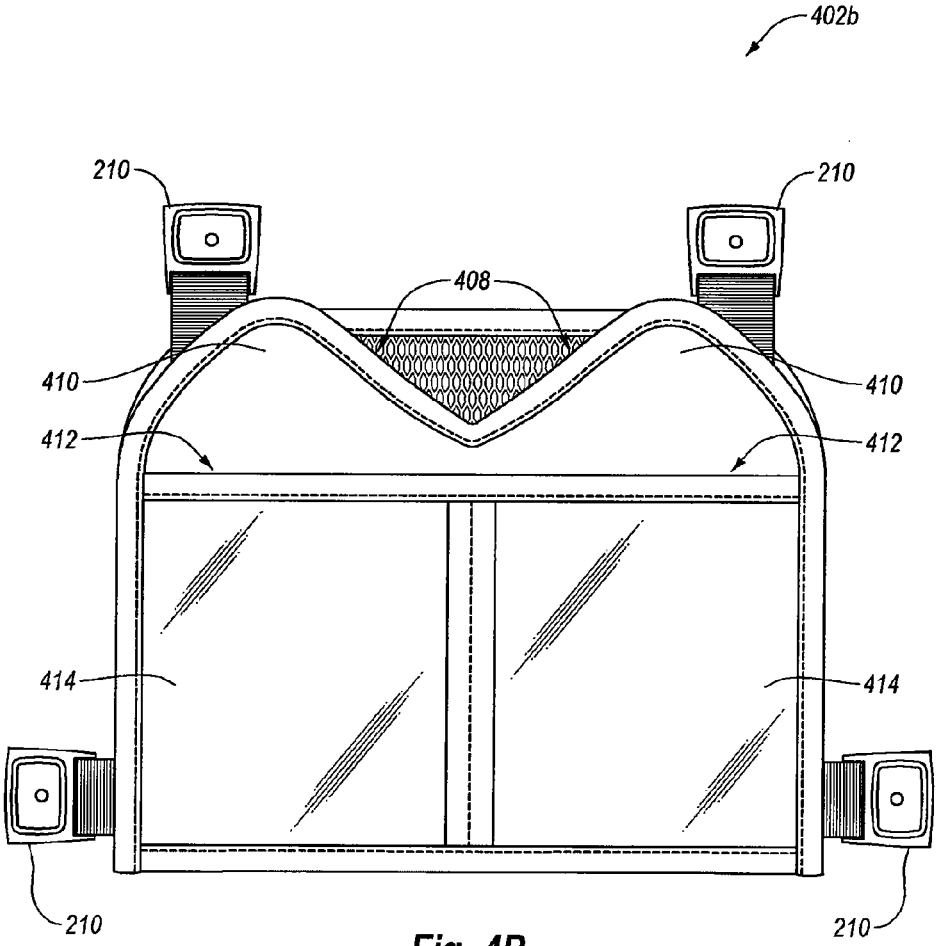
FIG. 4B illustrates another version of the interchangeable front pack shown in FIG. 4A.

Notwithstanding the configurations illustrated in FIGS. 3A through 3D, the interchangeable front pack 102 can have a wide-variety of configurations. FIGS. 4A and 4B illustrate additional implementations of the interchange front pack 102. For example, FIG. 4A illustrates an interchangeable front pack 402*a* having a front portion 404, a back portion 406, pockets 408, and pocket flaps 410. FIGS. 4A and 4B can include all the characteristics and variations as described above with respect to FIGS. 3A through 3C; however, FIGS. 4A and 4B illustrate that the interchangeable front pack 402*a* includes two equally sized pockets 408.

In addition, FIG. 4B illustrates that an interchangeable front pack 402*b* that additionally includes transparent pockets 412. The transparent pockets 412 can include the same or similar characteristics and variations as described above with respect to FIGS. 3A through 3C. Thus, FIGS. 4A and 4B show the contrast between various configurations of the interchangeable front pack 102, and illustrate how a user can choose between any number of interchangeable front packs 102 to connect to the modular outdoor pack depending on the desires and needs of a user during a particular outdoor activity.

Figure 5A:
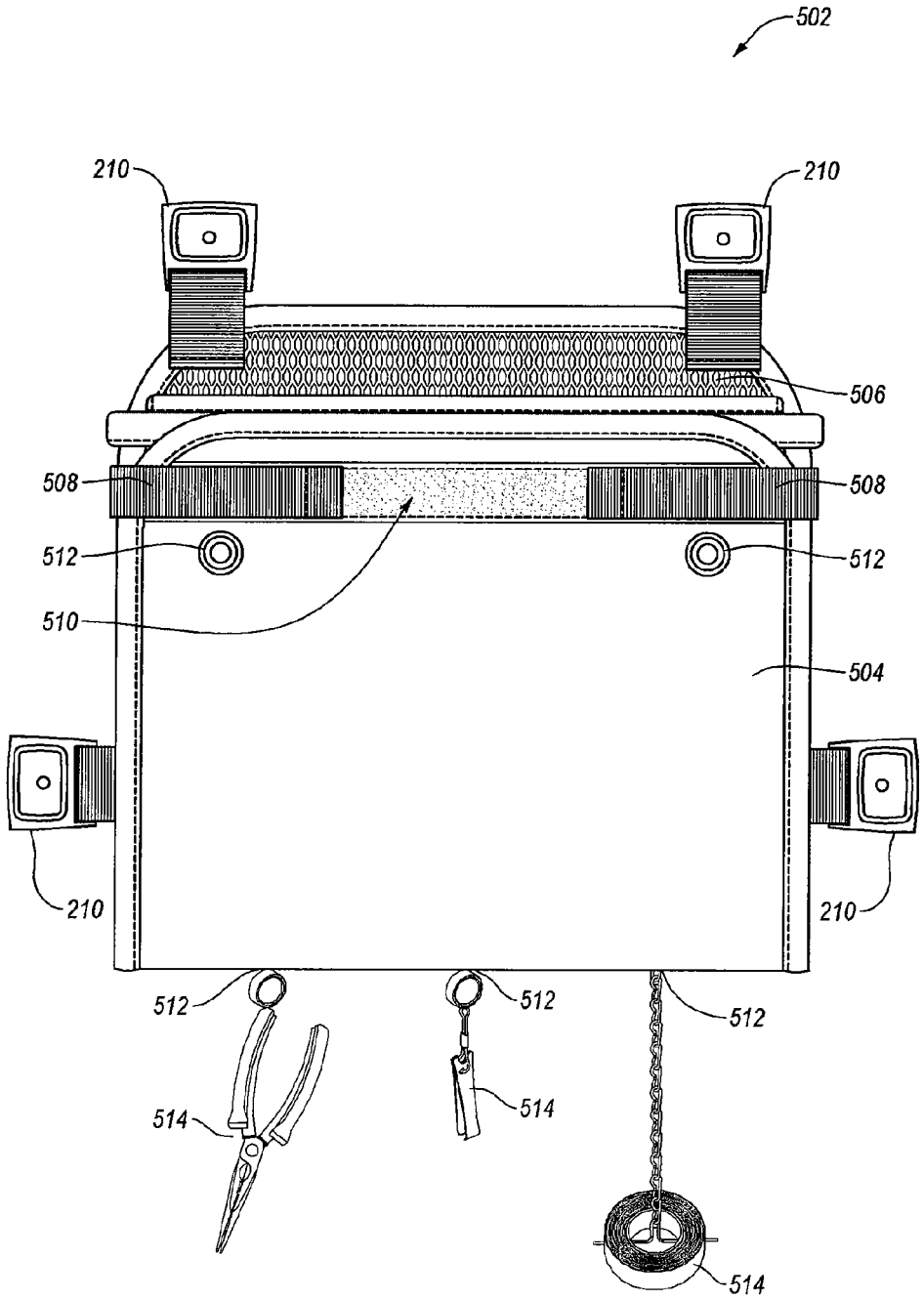
FIG. 5A illustrates another example of an interchangeable front pack for use with the modular packing system in a closed position.
Figure 5B:
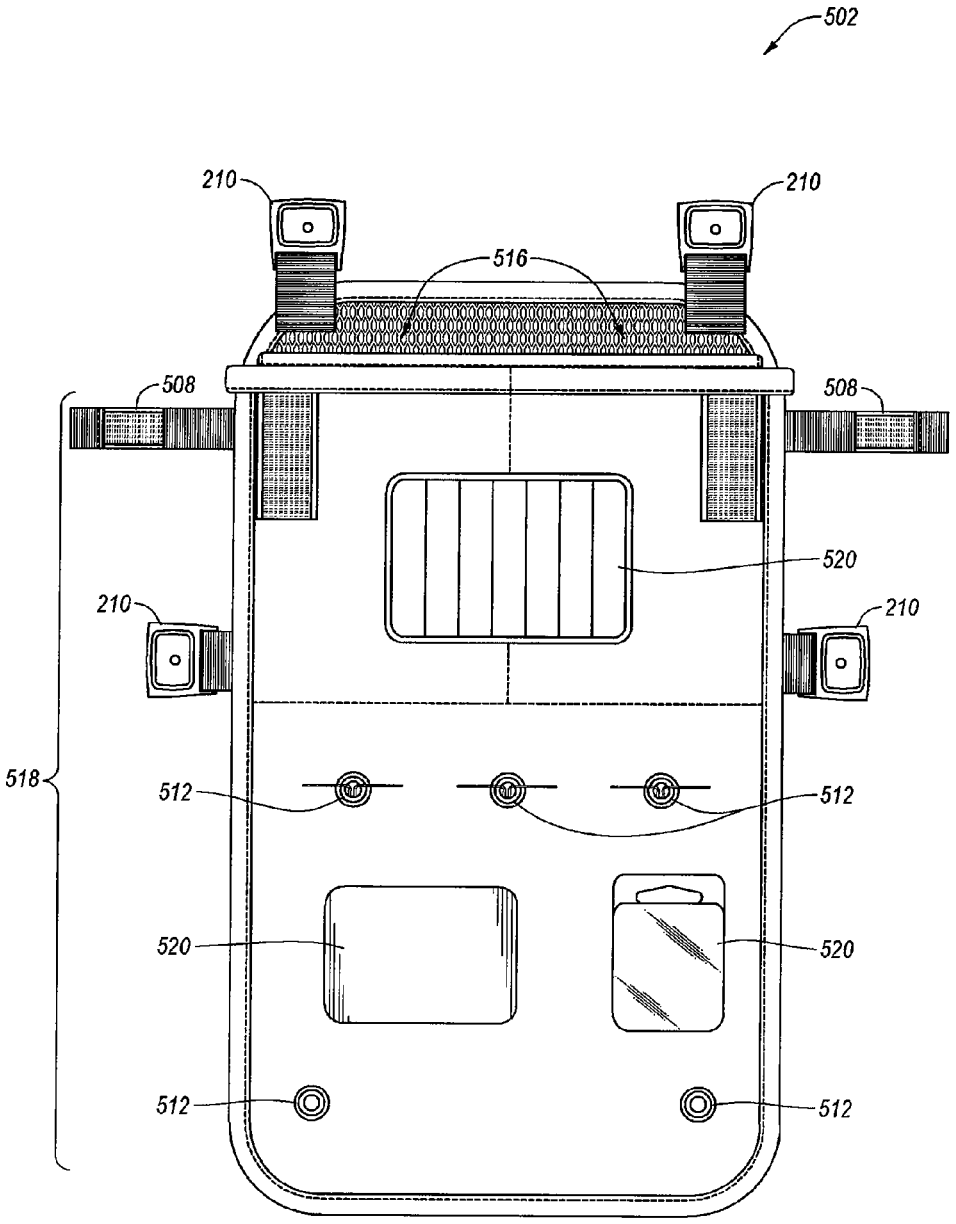
FIG. 5B illustrates the interchangeable front pack illustrated in FIG. 5A in an open position.

As discussed above, the interchangeable front pack 102 can be configured for a variety of activities. To further illustrate this general principle, FIGS. 5A and 5B illustrate a further implementation of an example interchangeable fishing pack 502 that a user can wear while fishing. Although FIGS. 5A and 5B illustrate the interchangeable fishing pack 502, the present invention is not limited to simply a fishing pack or packs with pockets; rather, example implementations of the invention can be customized for any particular activity. For example, the interchangeable front pack 102 can be customized with features for any particular outdoor activity.

Nevertheless, in reference to the interchangeable fishing pack 502, FIG. 5A illustrates that the interchangeable fishing pack 502 in a closed position, while FIG. 5B illustrates the interchangeable fishing pack 502 in an open position. As FIGS. 5A and 5B illustrate, the interchangeable fishing pack 502 includes a front portion 504 coupled to a back portion 506. The front portion 504 has a folded configuration while in the closed position (see FIG. 5A) and an unfolded configuration while in the open position (see FIG. 5B).

While in the closed position, FIG. 5A illustrates that the interchangeable fishing pack 502 can include straps 508 that can attach to a strap fastener 510. The straps 508 can selectively attach and detach from the strap fastener 510 in order for a user to secure the front portion 504 in the closed position by attaching the straps 508 to the strap fastener 510. Likewise, when a user desires to open the front portion 504, the user can detach the straps 508 from the strap fastener 510 and unfold or open the front portion 504.

The nature and configuration of the straps 508 can vary from one implementation to the next. For example, FIG. 5A illustrates that the straps 508 and strap fastener 510 can include VELCRO or other similar material in order to selectively attach the straps 508 to the strap fastener 510. In alternative implementations, the straps 508 can include snaps, hooks, or other similar fastening devices with corresponding devices for the strap fastener 510.

The ability to open and close the front portion 504 allows a user to easily store fishing equipment and tackle inside the folded front portion 504 while the user is fishing. When the user need access to the fishing equipment, however, the front portion 504 can easily be opened to allow easy access to the fishing equipment. For example, FIG. 5B illustrates the interchangeable fishing pack 502 in the open position. As is shown, the when in the open position, the front portion 504 reveals a mounting surface 518 that is configured to hold various boxes and tackle directly on the mounting surface 518.

For example, FIG. 5B illustrates that the mounting surface 518 can comprise a surface to which VELCRO, or other similar fasteners, can stick. Therefore, and as illustrated, a user can mount one or more tackle boxes 520 that are configured to safely and securely hold flies, hooks, bate, and other fishing equipment. For example, the boxes can include a VELCRO strip on the bottom of the box 520 to attach to the mounting surface.

In one implementation, the tackle boxes 520 can be removed and carried by the user into a fishing store such that the user can select the flies for a particular fishing trip, place the flies into the tackle box 520, and then mount the tackle box 520 to the mounting surface 518 to use while the user is wearing the modular outdoor pack 100. A user may also wish to label or organize various tackle boxes 520 for particular locations or seasons, thus easily storing and organizing the tackle boxes 520, and then mounting a particular tackle box 520 to the mounting surface 518 of the interchangeable fishing pack 502 based on the location and season of a particular fishing trip.

The tackle boxes 520 can come in a variety of sizes and shapes. In addition, implementations of the invention provide tackle that is sold directly in the tackle boxes 520 so that a user can simply by the tackle in a box that will automatically attach to the mounting surface 518. Moreover, the tackle boxes 520 can include a foam interior, such that hooks and flies can easily be attached to the foam for storage within the tackle box 520.

In addition to carrying various tackle boxes 520, the interchangeable fishing pack 502 can also include one or more eyelets 512. For example, FIGS. 5A and 5B illustrate that the interchangeable fishing pack 502 can include three lower eyelets 512 and three upper eyelets 512. A user can use the eyelets to mount a variety of fishing gear to the interchangeable fishing pack 502. For example, FIG. 5A illustrates that various tools 514 can be mounted to the interchangeable fishing pack 502 through the eyelets. For example, tools such as tape, pliers, pocket knives, and other tools 514, can be mounted to the interchangeable fishing pack 502.

In particular, the tools 514 can be attached to a chain that is secured within the eyelet 512. In one implementation, the chain is long enough to allow a user to use the tool 514 without having to remove the tool from the chain. In an additional implementation, the tool 514 can be attached to a retractable line that allows the user to pull the tool away from the interchangeable fishing pack 502 to use the tool. After using the tool 514, the retractable line retracts, thus positioning the tool 514 adjacent to the interchangeable fishing pack 502, as illustrated in FIG. 5A.

Figure 6A:
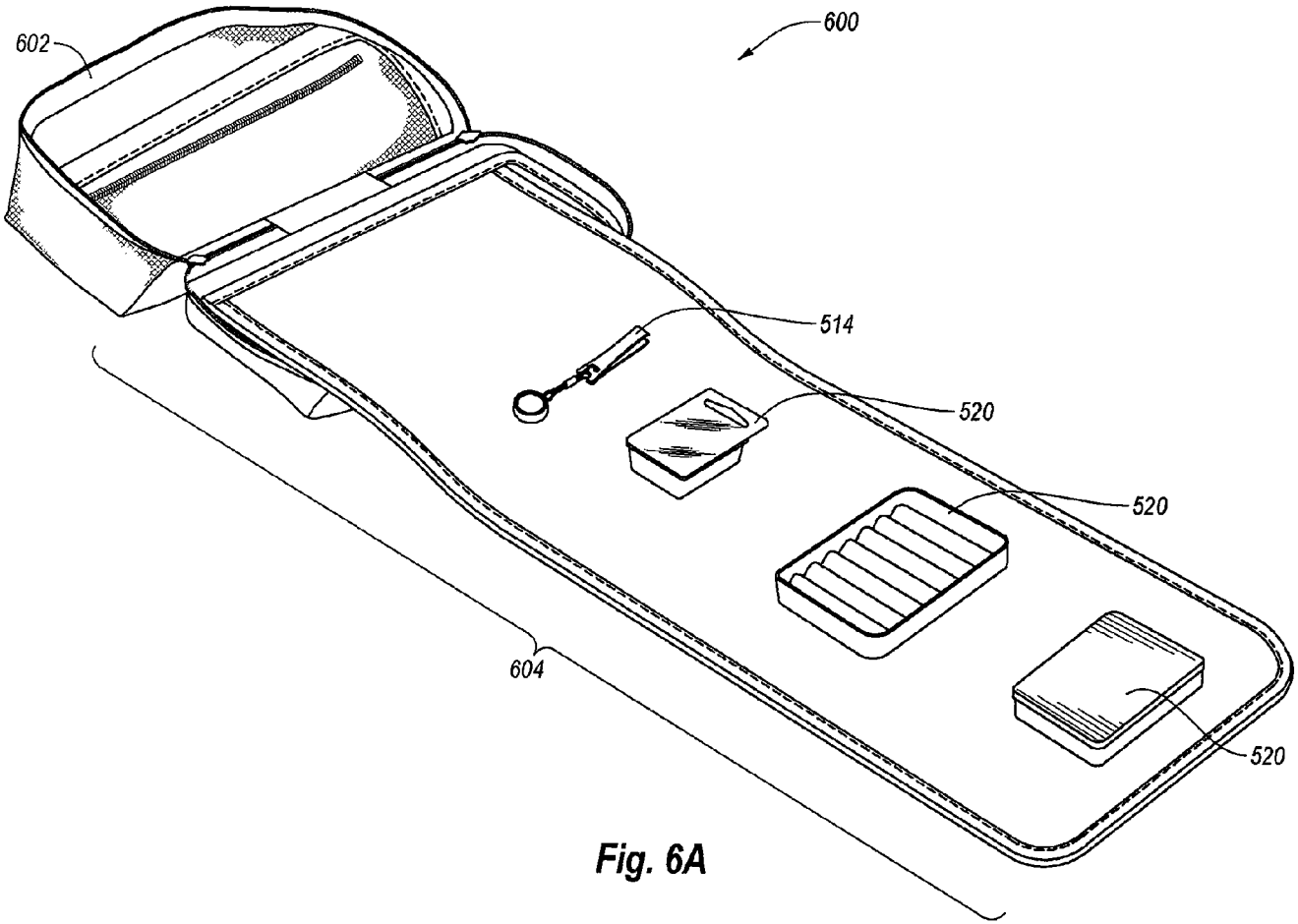
FIG. 6A illustrates an example of a modular tackle box for use with the interchangeable front pack illustrated in FIGS. 5A and 5B in a fully open position.
Figure 6B:
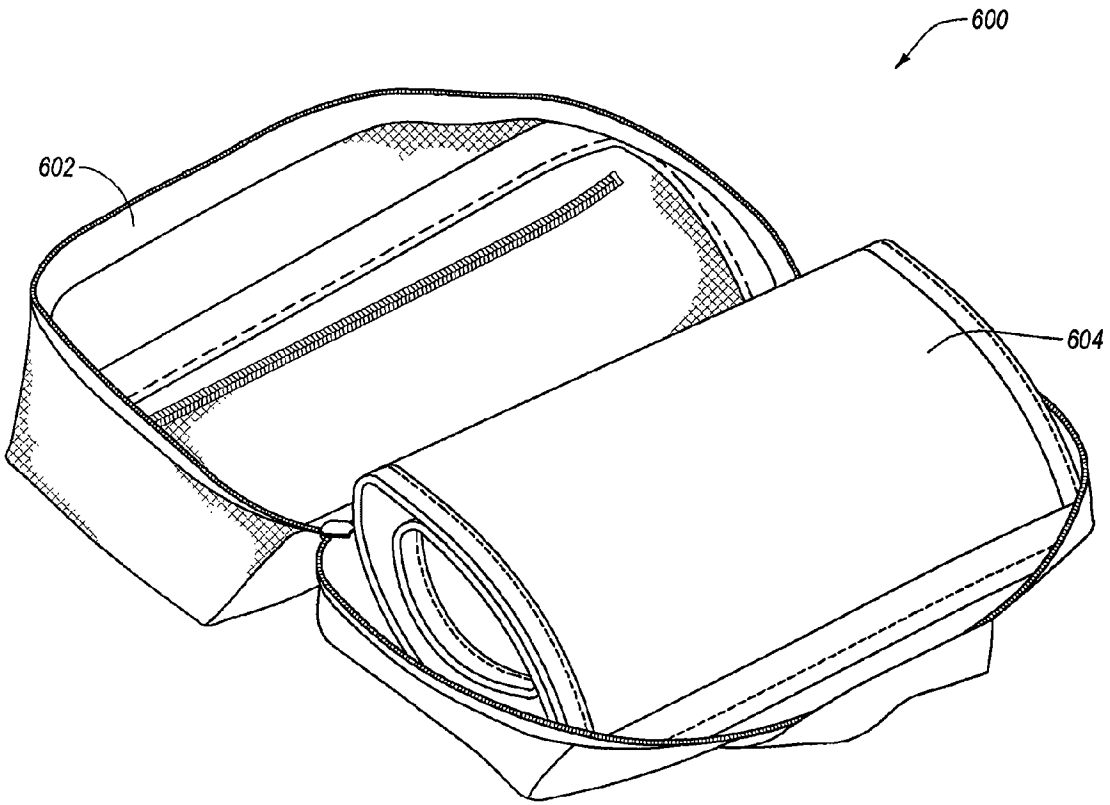
FIG. 6B illustrates the modular tackle box illustrated in 6A in an intermediate open position.
Figure 6C:
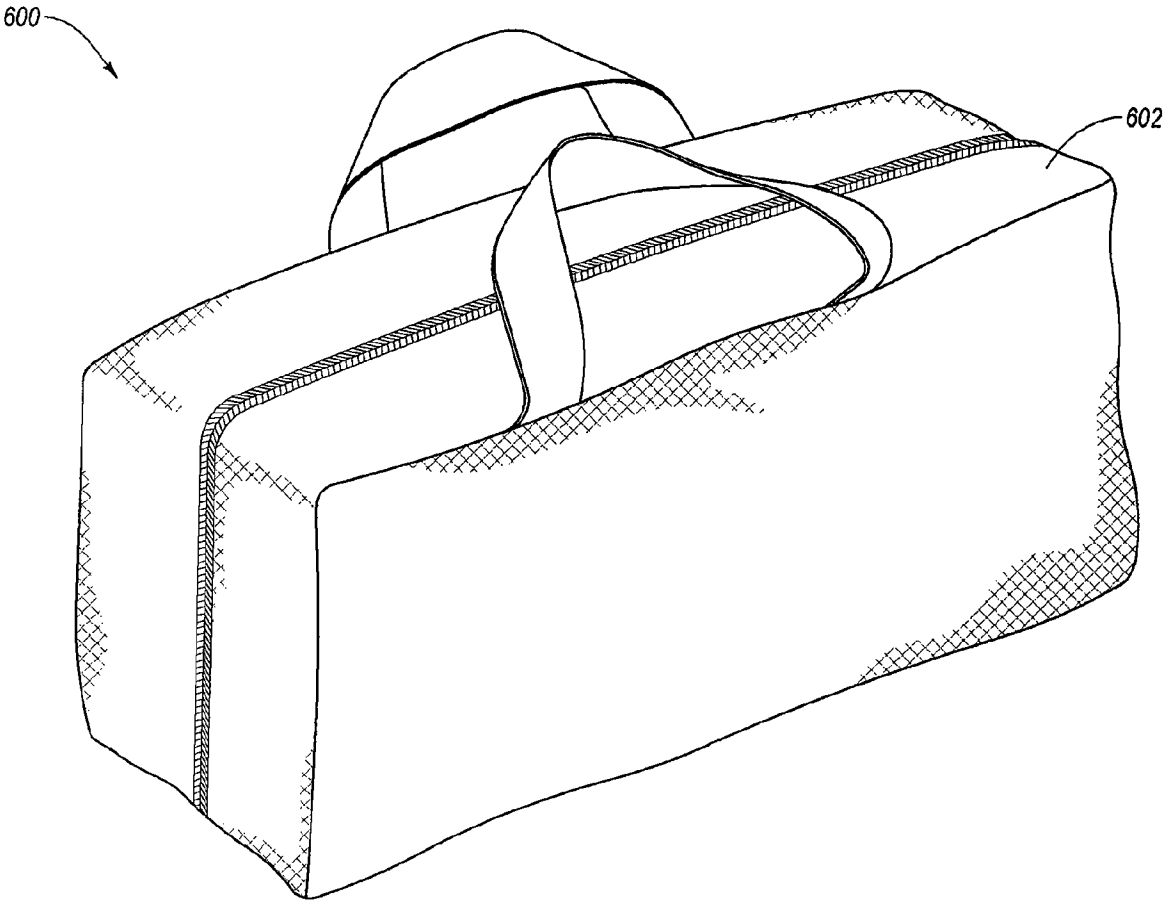
FIG. 6C illustrates the tackle container illustrated in a fully closed position.

Implementations of the interchangeable fishing pack 502 can also be used in conjunction with a modular tackle box 600. For example, FIGS. 6A through 6C illustrate one example implementation of the modular tackle box 600. In particular, FIG. 6A illustrates the modular tackle box 600 in an open configuration. When in the open configuration, the modular tackle box 600 includes a carrying case 602 that is open and a mounting surface 604 that is connected the carrying case on one end and extends therefrom.

As FIG. 6A illustrates, the mounting surface 604 has a length such that several boxes 606 (e.g., tackle boxes) can attach to the mounting surface 604. Moreover, one or more tools 514 can also be made to attach to the mounting surface 604. In one example implementation, the length of the mounting surface 604 is about two feet. In alternative implementations, the length of the mounting surface 604 can be longer or short than two feet depending on how much tackle a user wishes to carry in the modular tackle box 600.

For example, FIG. 6A illustrates that a plurality of boxes 606 can attach to the mounting surface 604. The mounting surface 604 of the modular tackle box 600 can have the same fastening properties as the mounting surface 518 of the interchangeable fishing pack 502, for example VELCRO. Therefore, a user can simply remove the box 606 from the mounting surface 604 of the modular tackle box 600 and attach that same box on the mounting surface 518 of the interchangeable fishing pack 502.

When not in use, the modular tackle box 600 can be configured into a closed position. FIG. 6B illustrates that a user can fold or roll the mounting surface 604 such that the mounting surface 604 is substantially contained within the confines of the carrying case 602. The boxes 520 stay attached to the mounting surface 604 as the user folds or rolls the mounting surface 604, thus securing the tackle, bait, and other fishing equipment securely within the rolled mounting surface 604.

Once a user folds or rolls the mounting surface 604, the user can then close the carrying case 602 of the modular tackle box 600 to create an easy and efficient way to transport and/or store the contents therein. For example, FIG. 6C illustrates that the carrying case 602 can close with a zipper that zips at least partially around the perimeter of the carrying case 602. In one implementation, the carrying case 602 can be sized such to enclose both the rolled mounting surface 604 as well as the interchangeable fishing pack 502 so that a user can simply take the carrying case 602 and have all the fishing equipment, as well as the pack, needed for a particular fishing trip.

Figure 7:
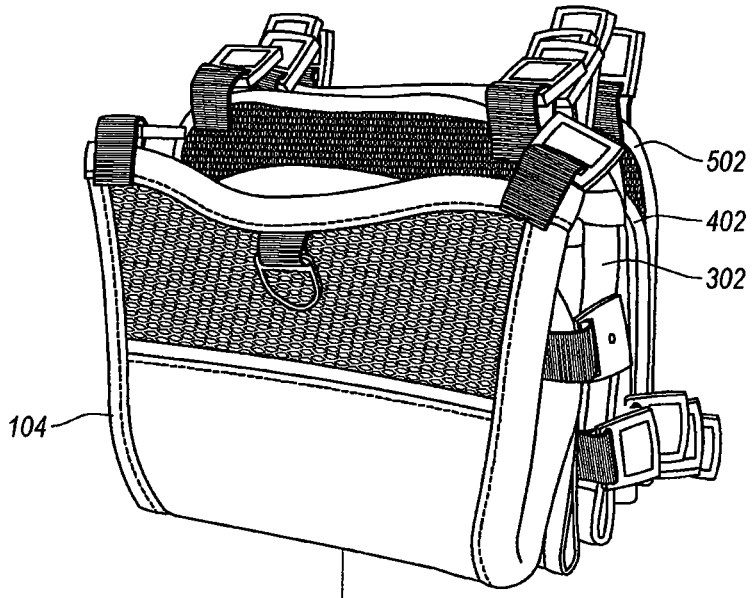
FIG. 7 illustrates an example of a modular outdoor pack system.
Figure 8:
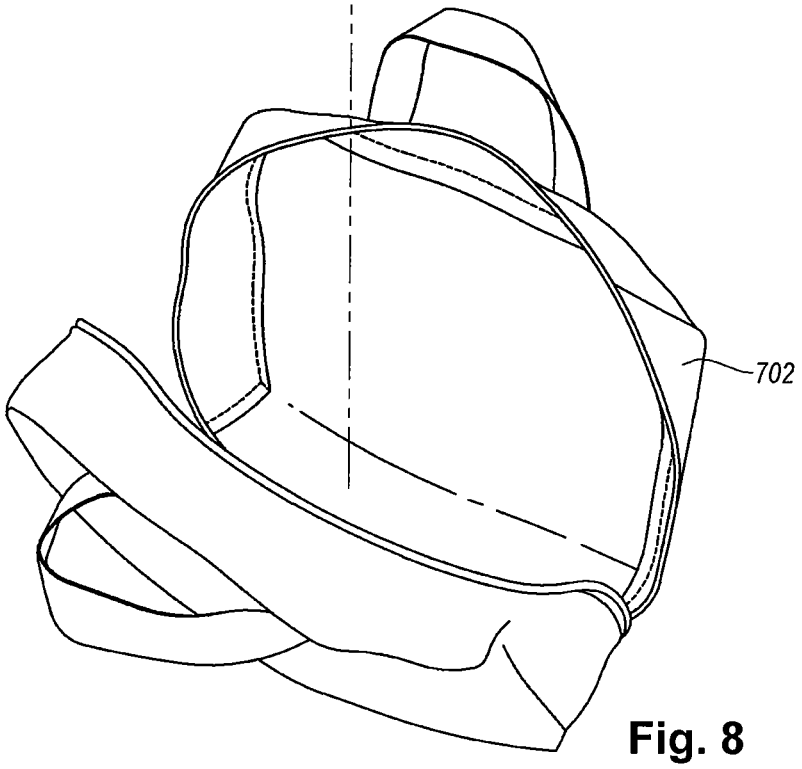
FIG. 8 illustrates a carrying case for the modular outdoor pack system shown in FIG. 7.

Similarly, implementations of the present invention can include a pack carrying case 702 that a user can use to store and/or carry the various base back packs 102 as well as the various interchangeable front packs 102. For example, FIG. 7 illustrates on example of the pack carrying case 702. As FIG. 7 illustrates, the various interchangeable front packs 102 (e.g., 302, 402, and 502) as well as the base back pack 104 can be placed in the carrying case 702. Therefore, a user can store and/or carry the various packs that make up the modular outdoor pack 100 such that a user can have access to various modular outdoor pack 100 configurations while only having to take the contents of the carrying case 702.

For example, a user may be planning an outdoor adventure trip that involves hiking, fishing, biking and/or various other outdoor activities. In such a situation, the user need only take the carrying case 702 with the various interchangeable front packs 102 and the base back pack 104. Thus, the user can configure the modular outdoor pack 100 to any customized configuration needed for the particular activity. In other words, instead of having to bring several different packs, a user need only bring the modular outdoor pack 100 that is contained in the carrying case 702, and the user will have access to a variety of different pack configurations customized for particular activities.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A modular outdoor packing system comprising:

a base back pack including:

a first portion comprising a first air mesh material that forms a first ventilating surface configured to rest against a back area of a user;

a second portion attached to said first portion; and a receiving space at least partially defined between said first portion a said second portion; and a plurality of interchangeable front packs, each of said plurality of interchangeable front packs being configured for different outdoor activities and including:

a third portion comprising a second air mesh material that forms a second ventilating surface configured to rest directly against a chest area of the user; and a fourth portion connected to said third portion, said fourth portion including an elastic material;

one or more pockets defined by said third portion and said fourth portion; and one or more pocket flaps connected to or forming a part of said fourth portion of said interchangeable front pack, said one or more pocket flaps being foldable from said fourth portion toward the chest area of the user and tuckable at least about half-way down a height of said one or more pockets and between said third portion and said fourth portion, said fourth portion and said one or more pocket flaps arranged to exert a compressive force on contents of said one or more pockets to secure the contents within said one or more pockets; and a plurality of detachable straps that selectively extend between said base back pack and said plurality of interchangeable front packs one at a time.

2. The modular packing system of claim 1, wherein said second air mesh material includes a top layer of linked nylon, a bottom layer of linked nylon, and a plurality of nylon strands woven between and coupling said top layer and said bottom layer, said nylon strands forming a compressible support structure between said top layer and said bottom layer.

3. The modular packing system of claim 2, wherein a portion of said nylon strands have at least one of a varying length, a varying cross-sectional dimension, or a varying stiffness.

4. The modular packing system of claim 1, wherein said one or more pocket flaps are arranged to substantially seal the contents of said one or more pockets within said one or more pockets.

5. The modular packing system of claim 1, where said one or more pocket flaps and said fourth portion are arranged to fully enclose said one or more pockets.

6. The modular packing system of claim 1, wherein said fourth portion and said one or more pocket flaps comprise a single member.

7. The modular packing system of claim 6, wherein said fourth portion includes a neoprene material arranged to securely hold the contents of said one or more pockets.

8. The modular packing system of claim 1, wherein at least one of said interchangeable front packs has a width of less than about 0.5 inches such that a user can wear the modular packing system as a layer on top of clothing or underneath clothing.

9. The modular packing system of claim 1, wherein said third portion has a height greater than a height of said fourth portion.

10. The modular packing system of claim 1, wherein said one or more pockets include one or more elastic compression properties configured to facilitate securing the contents therein.

11. The modular packing system of claim 1, wherein said plurality of interchangeable front packs include a biking pack, a hiking pack, and a fishing pack including one or more tackle boxes attached to an outer surface of said third portion within said one or more pockets.

12. The modular packing system of claim 1, further comprising one or more panel members comprising transparent material that are at least partially connected to an outer surface of said fourth portion of said interchangeable front pack, said one or more panel members and said fourth portion of said interchangeable front pack at least partially defining one or more transparent pockets therebetween.

13. The modular system of claim 1, wherein said fourth portion of said interchangeable front pack is rotatable relative to said third portion of said interchangeable front pack and is movable between a closed position, wherein said fourth portion and said third portion at least partially define said one or more pockets, and an open position, wherein said fourth portion is rotated away from said third portion and forms a mounting surface on an inner surface of said fourth portion.

14. The modular system of claim 1, wherein an upper edge portion of said second portion of said base back pack is substantially linear and a lower portion of said second portion of said base back pack includes a curved edge.

15. The modular packing system of claim 1, wherein said plurality of detachable straps comprise:

a first pair of detachable straps extending between an upper edge portion of said first portion of said base back pack and an upper edge portion of said third portion of said interchangeable front pack, said first pair of detachable straps configured to extend over a shoulder area of the user; and a second pair of detachable straps extending between side portions of said first portion of said base back pack and said third portion of said interchangeable front pack, said second pair of detachable straps configured to extend around opposite side areas of the user.

16. A modular outdoor packing system comprising:

a plurality of interchangeable base back packs, each of said plurality of interchangeable base back packs being configured for different activities and including:

a first portion comprising a first air mesh material that forms a first ventilating surface configured to rest against a back area of a user;

a second portion connected to said first portion, said second portion comprising a first stretchable material;

a receiving space at least partially defined between said first portion and said second portion; and a plurality of interchangeable front packs, each of said plurality of interchangeable front packs being configured for different activities and including:

a third portion comprising a second air mesh material that forms a second ventilating surface configured to rest directly against a chest area of a user, wherein at least one of said first air mesh material or said second air mesh material includes a top layer of linked nylon, a bottom layer of linked nylon, and a plurality of nylon strands woven between and coupling said top layer and said bottom layer, said nylon strands forming a compressible support structure between said top layer and said bottom layer; and a fourth portion connected to said third portion, said fourth portion comprising a second stretchable material; and one or more pockets at least partially defined between said third portion and said fourth portion;

one or more pocket flaps connected to or forming a part of said fourth portion of said interchangeable front pack, said one or more pocket flaps being bendable from said fourth portion toward the chest area of the user and tuckable at least about half-way down a height of said one or more pockets and between said third portion and said fourth portion, said fourth portion and said one or more pocket flaps arranged to exert a compressive force on contents of said one or more pockets to secure the contents within said one or more pockets; and a first pair of detachable straps extending between an upper edge portion of said first portion of said base back pack and an upper edge portion of said third portion of said interchangeable front pack, said first pair of detachable straps configured to extend over a shoulder area of the user; and a second pair of detachable straps extending between side edge portions of said first portion of said base back pack and side edge portions of said third portion of said interchangeable front pack, said second pair of detachable straps configured to extend over side areas of the user.

17. The modular outdoor packing system of claim 16, wherein the combination of said first portion of said base back pack, said third portion of said interchangeable front pack, and said first and second pairs of detachable straps is configured to selectively form a compression fit over a torso area of the user.

* * * * *